US007182636B2

(12) United States Patent
Chen

(10) Patent No.: US 7,182,636 B2
(45) Date of Patent: Feb. 27, 2007

(54) SCSI CONNECTOR ASSEMBLY WITH REDUCED WIDTH

(75) Inventor: Chien-Chiu Chen, Taipei (TW)

(73) Assignee: Advanced Connectek Inc., Taipei Hsien (TW)

( * ) Notice: Subject to any disclaimer, the term of this patent is extended or adjusted under 35 U.S.C. 154(b) by 0 days.

(21) Appl. No.: 11/411,794

(22) Filed: Apr. 27, 2006

(65) Prior Publication Data

US 2006/0281366 A1 Dec. 14, 2006

(30) Foreign Application Priority Data

Jun. 10, 2005 (TW) ..... 94209731 U

(51) Int. Cl.
*H01R 13/44* (2006.01)

(52) U.S. Cl. ..... 439/541.5

(58) Field of Classification Search ..... 439/541.5, 439/607, 701

See application file for complete search history.

(56) References Cited

U.S. PATENT DOCUMENTS 5,336,109 A * 8/1994 Hillbish et al. ..... 439/541.5
6,074,248 A * 6/2000 Huang ..... 439/541.5
6,159,040 A * 12/2000 Chang et al. ..... 439/541.5
6,168,462 B1 * 1/2001 Liao ..... 439/541.5
6,736,676 B2 * 5/2004 Zhang et al. ..... 439/607
6,935,896 B1 * 8/2005 Tsai ..... 439/607

* cited by examiner

*Primary Examiner*—Tulsidas C. Patel
*Assistant Examiner*—Harshad C Patel
(74) *Attorney, Agent, or Firm*—Troxell Law Office, PLLC

(57) ABSTRACT

A SCSI connector assembly includes a housing including forward upper and lower plates either having top and bottom grooves, a rear staged seat including upper and lower platforms and an intermediate, longer platform; four stacked rows of conductors of different configurations, each conductor including an electrical terminal and a bifurcation at both ends, the conductors passed through the housing to seat on the grooves; flat cables connected to the conductors and fastened by the bifurcations; a metal case secured to the housing; and four mounting boards each including two side pegs and two rows of valleys separated by a channel. The mounting boards are mounted on tops and bottoms of the platforms by inserting the pegs into side holes of the platforms. The cables are fastened by the valleys.

5 Claims, 2 Drawing Sheets

SCSI CONNECTOR ASSEMBLY WITH REDUCED WIDTH

BACKGROUND OF THE INVENTION

1. Field of Invention

The present invention relates to electrical connectors and more particularly to a SCSI (Small Computer System Interface) connector assembly with a reduced width by stacking conductors.

2. Description of Related Art

SCSI connectors are widely used to interconnect a computer and a peripheral. Conventionally, a SCSI connector has a single row of conductors. Also, it is typical of increasing width of the connector so as to accommodate an increased number of conductors. This inevitably contradicts the trend of compactness of modern electronic devices. Thus, the need for improvement still exists.

SUMMARY OF THE INVENTION

It is a main object of the present invention to provide a SCSI (Small Computer System Interface) connector assembly with a reduced width by stacking conductors.

It is therefore another of the present invention to provide an electrical connector assembly comprising an insulative connector housing including a rectangular body, a rectangular upper plate extended forward, a rectangular lower plate extended forward, the lower plate having a width different from that of the upper plate, either plate having a series of grooves formed on its top and bottom respectively, a plurality of first tabs formed on a top of the body, a plurality of second tabs formed on a bottom of the body, a rearward extended staged seat including an upper first platform, a lower first platform, an intermediate second platform longer than either one of the first platforms, a series of lengthwise first troughs formed on a top of the upper first platform and a bottom of the lower first platform respectively and extended through the body to connect to two series of grooves, a series of lengthwise second troughs formed on a top and a bottom of the second platform respectively and extended through the body to connect to the other two series of grooves, two longitudinal first holes formed on both sides of the upper first platform, two longitudinal first holes formed on both sides of the lower first platform, two longitudinal second holes formed on both sides of the top of the second platform, and two longitudinal second holes formed on both sides of the bottom of the second platform; four stacked rows of elongate conductors, each row of the conductors including first, second, and third configurations each including a plurality of conductors each including an electrical terminal at one end and a bifurcation at the other end wherein the rows of conductors are passed through the series of the first and second troughs with the electrical terminals seated on the series of grooves; a plurality of flat cables electrically connected to the rows of conductors and fastened by the bifurcations; a metal case including a front D-shaped flange and a rear rectangular frame including an opening in communication with the flange, a plurality of upper holes, and a plurality of lower holes wherein the case is secured onto a front end of the connector housing with the first and second tabs snugly projected from the upper and lower holes respectively; and four rectangular mounting boards each including two side pegs, two rows of lengthwise valleys, and a transverse channel separated the rows of valleys wherein two upper ones of the mounting boards are mounted on the tops of the upper first platform and the second platform respectively, two lower ones of the mounting boards are mounted on the bottoms of the lower first platform and the second platform respectively by securely inserting the pegs into the first and second holes, and the cables are fastened by the valleys.

In an aspect of the present invention the conductor of the first configuration further comprises an intermediate enlargement and a ramp proximate the other end, the conductor of the second configuration further comprises two intermediate enlargements, and the conductor of the third configuration further comprises an intermediate enlargement, a ramp proximate the other end, and a flat section interconnected the ramp and the bifurcation thereof.

In another aspect of the present invention there is provided the number of the first tabs is two, the number of the second tabs is two, the number of the upper holes is two, and the number of the lower holes is two.

The above and other objects, features and advantages of the present invention will become apparent from the following detailed description taken with the accompanying drawings.

DETAILED DESCRIPTION OF THE INVENTION

Figure 1:
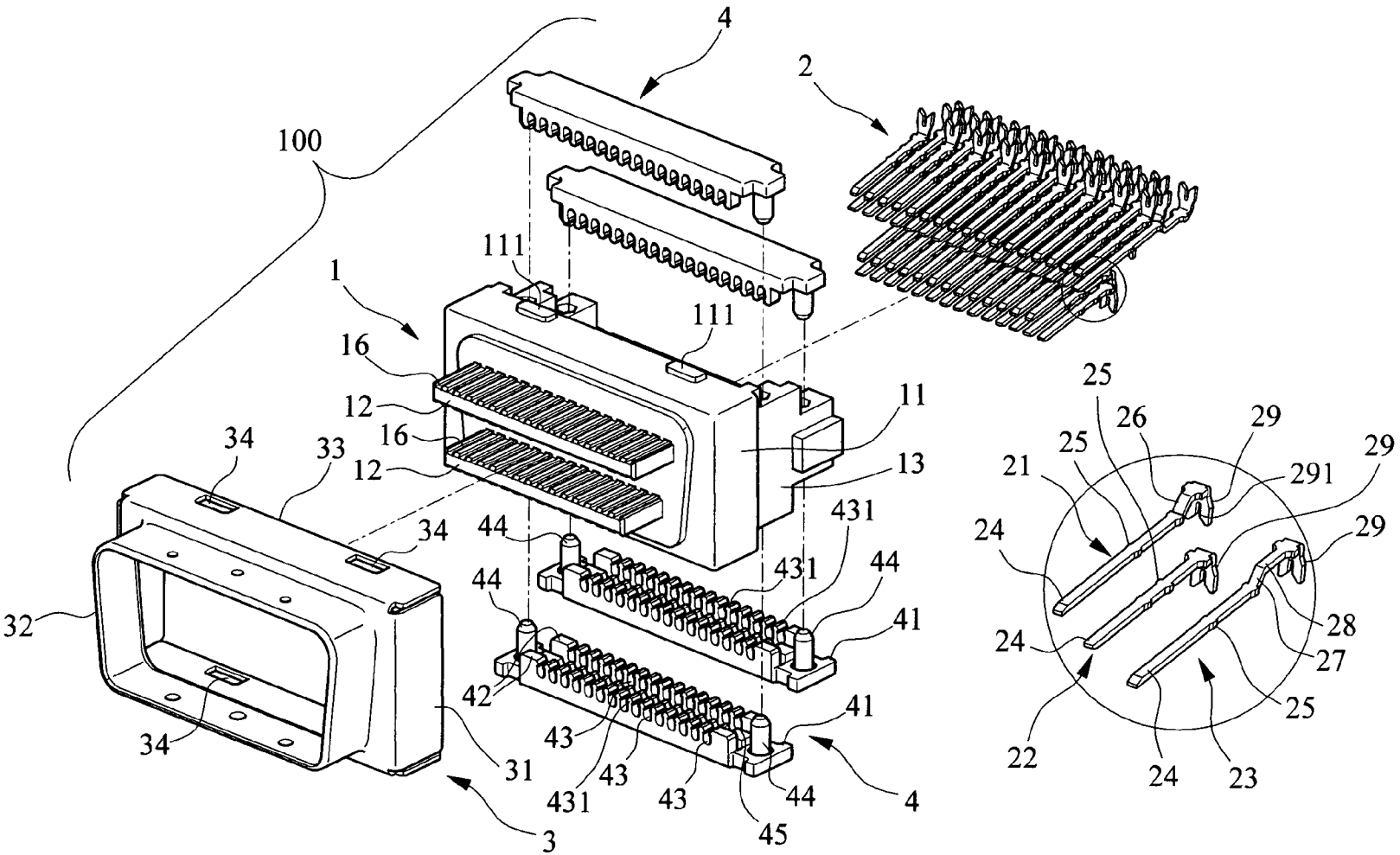
FIG. 1 is an exploded perspective view of a preferred embodiment of SCSI connector assembly according to the invention.
Figure 2:
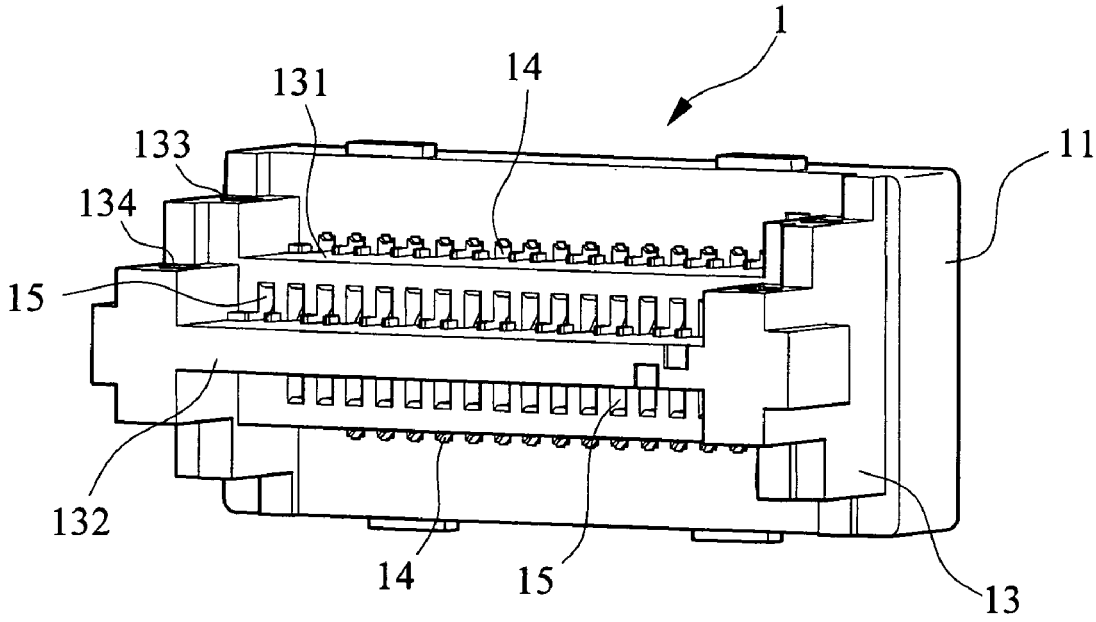
FIG. 2 is a perspective view of the connector housing.
Figure 3:
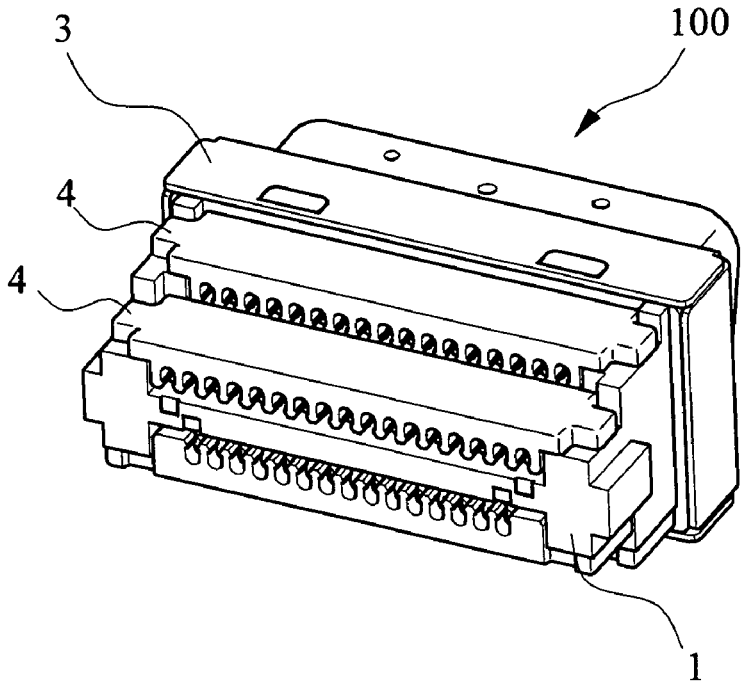
FIG. 3 is a perspective view of the assembled SCSI connector assembly.

Referring to FIGS. 1, 2, and 3, a SCSI connector assembly 100 in accordance with a preferred embodiment of the invention comprises an insulative connector housing 1, four stacked rows of conductors 2, a metal case 3, two upper mounting boards 4, and two lower mounting boards 4. Each component is discussed in detailed below.

The connector housing 1 comprises a rectangular body 11, upper and lower rectangular plates 12 extended forward in which the upper plate 12 has a width different from that of the lower plate 12, and each plate 12 has a series of grooves 16 formed on its top and bottom respectively, first tabs 111 on a top of the body 11, second tabs 111 on a bottom of the body 11, and a staged seat 13 extended rearward, the seat 13 including an upper first platform 131, an intermediate second platform 132, and a lower first platform 131 in which the second platform 132 is longer than the first platform 131 (i.e., the second platform 132 is extended further rearward). A series of lengthwise first troughs 14 are formed on a top of the upper first platform 131 and a bottom of the lower first platform 131 respectively. A series of lengthwise second troughs 15 are formed on a top and a bottom of the second platform 132 respectively. These four sets of series of troughs 14 and 15 are extended through the body 11 to connect to the four series of grooves 16 respectively. A longitudinal first hole 133 is formed on either side of the upper first platform 131. A longitudinal first hole 133 is formed on either side of the lower first platform 131. A longitudinal second hole 134 is formed on either side of the top of the second platform 132. A longitudinal second hole 134 is formed on either side of the bottom of the second platform 132.

The conductors 2 of the same row comprise three different configurations 21, 22, and 23 each having an elongate shape.

The first configuration 21 comprises an electrical terminal 24 at one end, an intermediate enlargement 25, a ramp 26 proximate the other end, and a bifurcation 29 having a U-shaped slot 291 at the other end. The second configuration 22 comprises an electrical terminal 24 at one end, two intermediate enlargements 25, and a bifurcation 29 at the other end. The third configuration 23 comprises an electrical terminal 24 at one end, an intermediate enlargement 25, a ramp 27 proximate the other end, a bifurcation 29 at the other end, and a flat section 28 interconnected the ramp 27 and the bifurcation 29.

The metal case 3 comprises a front D-shaped flange 32 and a rear rectangular frame 31 including an opening 33 in communication with the flange 32, two upper holes 34, and two lower holes 34.

The upper mounting boards 4 are identical to the lower mounting boards 4. The mounting board 4 has a rectangular shape and a flat top or bottom surface. The mounting board 4 comprises two side ears 41, two side pegs 44 of circular section, two risers 42 proximate either side, two rows of lengthwise valleys 43, a plurality of peaks 431 each formed between two adjacent valleys 43, and a transverse channel 45 separated the rows of lengthwise valleys 43.

An assembly of the invention will be described in detailed below. Pass four rows of conductors 2 having three different configurations 21, 22, and 23 through four sets of series of troughs 14 and 15 until the electrical terminals 24 of the conductors 2 are seated on four series of grooves 16. At this position, the enlargements 25 of the conductors 2 are secured to mated portions of the sets of series of troughs 14 and 15. Next, snap the case 3 onto a front end of the connector housing 1 with the tabs 111 snugly projected from the holes 34. As such, the case 3 and the connector housing 1 are secured together. Next, connect the conductors 2 to flat cables (not shown) which are fastened by the U-shaped slots 291 of the bifurcations 29. Mount the upper mounting boards 4 on tops of the upper first platform 131 and the second platform 132 and mount the lower mounting boards 4 on bottoms of the lower first platform 131 and the second platform 132 respectively by securely inserting the pegs 44 into the holes 133 and 134. At this position, the cables are fastened in the valleys 43. This completes the assembly as shown in FIG. 3.

While the invention herein disclosed has been described by means of specific embodiments, numerous modifications and variations could be made thereto by those skilled in the art without departing from the scope and spirit of the invention set forth in the claims.

What is claimed is:

1. An electrical connector assembly comprising:

an insulative connector housing including a rectangular body, a rectangular upper plate extended forward, a rectangular lower plate extended forward, the lower plate having a width different from that of the upper plate, either plate having a series of grooves formed on its top and bottom respectively, a rearward extended staged seat including an upper first platform, a lower first platform, an intermediate second platform, a series of lengthwise first troughs formed on a top of the upper first platform and a bottom of the lower first platform respectively and extended through the body to connect to two series of grooves, a series of lengthwise second troughs formed on a top and a bottom of the second platform respectively and extended through the body to connect to the other two series of grooves, two longitudinal first holes formed on both sides of the upper first platform, two longitudinal first holes formed on both sides of the lower first platform, two longitudinal second holes formed on both sides of the top of the second platform, and two longitudinal second holes formed on both sides of the bottom of the second platform;

four stacked rows of elongate conductors, each row of the conductors including first, second, and third configurations each including a plurality of conductors each including an electrical terminal at one end and a bifurcation at the other end wherein the rows of conductors are passed through the series of the first and second troughs with the electrical terminals seated on the series of grooves;

a metal case including a front D-shaped flange and a rear rectangular frame including an opening in communication with the flange, a plurality of upper holes, and a plurality of lower holes wherein the case is secured onto a front end of the connector housing with a plurality of first and second tabs snugly projected from the upper and lower holes respectively; and four rectangular mounting boards each including two side pegs, two rows of lengthwise valleys, and a transverse channel separated the rows of valleys wherein two upper ones of the mounting boards are mounted on the tops of the upper first platform and the second platform respectively, two lower ones of the mounting boards are mounted on the bottoms of the lower first platform and the second platform respectively by securely inserting the pegs into the first and second holes, and the cables are fastened by the valleys.

2. The electrical connector assembly of claim 1, wherein the conductor of the first configuration further comprises an intermediate enlargement and a ramp proximate the other end, the conductor of the second configuration further comprises two intermediate enlargements, and the conductor of the third configuration further comprises an intermediate enlargement, a ramp proximate the other end, and a flat section interconnected the ramp and the bifurcation thereof.

3. The electrical connector assembly of claim 1, wherein the number of the first tabs is two, the number of the second tabs is two, the number of the upper holes is two, and the number of the lower holes is two.

4. The electrical connector assembly of claim 1, wherein the assembly further comprises said plurality of first tabs formed on a top of the body and said plurality of second tabs formed on a bottom of the body.

5. The electrical connector assembly of claim 1, wherein said intermediate second platform is longer than either one of the first platforms.

* * * * *